US008938827B2

(12) United States Patent
Shimada et al.

(10) Patent No.: US 8,938,827 B2
(45) Date of Patent: Jan. 27, 2015

(54) SUPPORT MECHANISM FOR THE LEG BOTTOM SECTION OF A BED

(75) Inventors: Tatsuya Shimada, Tokyo (JP); Tooru Takada, Tokyo (JP); Jun Tomikawa, Tokyo (JP); Dan Kageyama, Tokyo (JP); Yuri Sasaki, Tokyo (JP); Katsuyoshi Nomura, Tokyo (JP)

(73) Assignee: Paramount Bed Co., Ltd., Tokyo (JP)

( * ) Notice: Subject to any disclaimer, the term of this patent is extended or adjusted under 35 U.S.C. 154(b) by 1177 days.

(21) Appl. No.: 12/742,326

(22) PCT Filed: Sep. 4, 2008

(86) PCT No.: PCT/JP2008/065980

§ 371 (c)(1),
(2), (4) Date: May 11, 2010

(87) PCT Pub. No.: WO2009/110121

PCT Pub. Date: Sep. 11, 2009

(65) Prior Publication Data

US 2010/0251483 A1 Oct. 7, 2010

(30) Foreign Application Priority Data

Mar. 3, 2008 (JP) ..... 2008-052500

(51) Int. Cl.

| | |
|---|---|
| ***A47B 7/02*** | (2006.01) |
| ***A61G 7/075*** | (2006.01) |
| ***A47C 20/04*** | (2006.01) |
| ***A61G 7/015*** | (2006.01) |

(52) U.S. Cl.

CPC ..... *A61G 7/0755* (2013.01); *A47C 20/043* (2013.01); *A61G 7/015* (2013.01)

USPC ..... 5/613; 5/618; 5/617

(58) Field of Classification Search

USPC ..... 5/613–619

See application file for complete search history.

(56) References Cited

U.S. PATENT DOCUMENTS 6,839,926 B2 * 1/2005 Heimbrock et al. ..... 5/618

FOREIGN PATENT DOCUMENTS

| | | |
|---|---|---|
| JP | 7-16132 | 1/1995 |
| JP | 10-243837 | 9/1998 |

OTHER PUBLICATIONS

International Search Report issued Oct. 7, 2008 in International (PCT) Application No. PCT/JP2008/065980.

*Primary Examiner* — Peter M Cuomo
*Assistant Examiner* — Brittany Wilson
(74) *Attorney, Agent, or Firm* — Wenderoth, Lind & Ponack, LLP

(57) ABSTRACT

A support mechanism in which one end of a knee bottom section (2) is supported on a bed frame (1) in such a manner that the knee bottom section can be pivotally raised and lowered. Also, one end of a leg bottom section (6) is pivotally rotatably connected with the other end of the knee bottom section, a support stay (7) is pivotally rotatably connected with the underside of the other end of the leg bottom section, and a support device (11) of a support portion (9) provided at the opposite tip of the support stay is provided on the bed frame. The support device includes a guide portion (12) and an engaging portion (13) for movably supporting the support portion of the support stay. The guide portion can support the support portion moved in relation with the pivotal rotation of the knee bottom section within the entire pivotal rotation range of the knee bottom section. The engaging portion is provided above or below a vacant portion adjacent to the end portion of the guide portion on which the support portion is located when the knee bottom section is pivotally lowered.

7 Claims, 7 Drawing Sheets

SUPPORT MECHANISM FOR THE LEG BOTTOM SECTION OF A BED

BACKGROUND OF THE INVENTION

1. Technical Field

The present invention relates to a support mechanism for the leg bottom section of a bed.

2. Description of the Related Art

Presently widely used medical and household beds are designed for allowing the back bottom section and the knee bottom section of each bed to be pivotally raised and lowered so that the bed user can be supported on the bed in his/her comfortable position in response to each case.

In each of the conventional beds, one end of the leg bottom section is pivotally rotatably connected with the knee bottom section, and the other end of the leg bottom section is kept supported on the support face of the bed frame or a pair of support stays are pivotally rotatably connected with the underside of the other end of the leg bottom section so that the support stays can support the leg bottom section above the bed frame.

For example, in JP 63-125213A, a pair of support stays are pivotally rotatably connected with the underside of the other end of the leg bottom section, and the opposite tips of the support stays are supported by a pair of support means installed on the bed frame so that the other end of the leg bottom section can be supported above the bed frame. The pair of support means consist of multiple pairs of engaging recesses disposed in the longitudinal direction of the bed frame and the height of the other end of the leg bottom section can be adjusted by fitting the opposite tips of the support stays into a pair of engaging recesses selected from the multiple pairs of engaging recesses.

FIGS. 13 to 18 typically show an example of the conventional support mechanism for the leg bottom section.

Symbol a indicates a bed frame, and one end of a knee bottom section b is supported by the bed frame a so that the knee bottom section b can be pivotally raised and lowered. Symbol c indicates a pair of boost arms pivotally rotatably supported by the bed frame a, and the boost arms c are connected with an actuator e via an action member d so that the actuator can be moved in the right/left direction in the drawings to pivotally raise and lower the knee bottom section b. One end of a leg bottom section f is pivotally rotatably connected with the other end of the knee bottom section b, and a pair of support stays g are pivotally rotatably connected with the underside of the other end of the leg bottom section f.

As shown in FIG. 13, the pair of support stays g are installed on the right and left sides in the transverse direction of the leg bottom section f, and the opposite tips of the support stays g are connected with each other by a connecting rod h. The near end portions of the connecting rod h beyond the opposite tips of the support stays g function as support portions i, and the extreme ends beyond the near end portions are cranked to form handle portions j. On the other hand, on the bed frame a, a pair of support members o, each having two engaging recesses m and n to be engaged with the support portions i in the longitudinal direction, are provided.

SUMMARY OF THE INVENTION

1. Problem to be Solved by the Invention

In the above configuration, in the state where the knee bottom section b is pivotally raised, in the case where the support portions i are engaged with the engaging recesses m as shown in FIG. 15, the other end of the leg bottom section f is supported at a high position by the support stays g forming a large angle against the bed frame a.

If the knee bottom section b is pivotally lowered from this state, the movement of the leg bottom section f rightward in the drawings caused by the pivotal lowering of the knee bottom section b can be absorbed by the pivotal rotation of the support stays g forming a large angle against the bed frame a, and as shown in FIG. 16, while the support portions i are engaged with the engaging recesses m, the knee bottom section b and the leg bottom section f can be pivotally lowered to lie flat. Therefore, if the knee bottom section b is pivotally raised from this state, the other end of the leg bottom section f is supported at a high position again as shown in FIG. 14.

On the other hand, in the state where the knee bottom section b is pivotally raised, in the case where the support portions i are engaged with the engaging recesses n as shown in FIG. 18, the other end of the leg bottom section f is supported at a low position by the support stays g forming a small angle against the bed frame a as shown in FIG. 17.

If the knee bottom section b is pivotally lowered from this state, the movement of the leg bottom section f rightward in the drawings caused by the pivotal lowering of the knee bottom section b cannot be absorbed by the pivotal rotation of the support stays g forming a small angle against the bed frame a.

Therefore, the support portions i are gradually moved rightward in the drawings as indicated by an arrow in FIG. 18, and when the knee bottom section b and the leg bottom section become flat, the support portions i moved from the engaging recesses n to the engaging recesses m are finally engaged with the engaging recesses m, to reach the state as shown in FIG. 16.

Therefore, if the knee bottom section b is next pivotally raised from this state, the state as shown in FIG. 17 where the other end of the leg bottom section f is supported at a low position by the support stays g forming a small angle against the bed frame a cannot be obtained, and only the state as shown in FIG. 14 where the other end of the leg bottom section f is supported at a high position can be obtained.

Further, in the state where the knee bottom section b and the leg bottom section f lie flat as shown in FIG. 16, the support portions i cannot be moved to be engaged with the engaging recesses n, and can be moved to achieve this engagement only after the knee bottom section b is pivotally raised. Therefore, the operation for obtaining the bottom state as shown in FIG. 17 is troublesome.

The object of this invention is to solve the above-mentioned problem.

2. Means for Solving the Problem

To solve the abovementioned problem, this invention proposes a support mechanism for the leg bottom section of a bed, characterized in that one end of a knee bottom section is supported on a bed frame in such a manner that the knee bottom section can be pivotally raised and lowered, that one end of a leg bottom section is pivotally rotatably connected with the other end of the knee bottom section, that a support stay is pivotally rotatably connected with the underside of the other end of the leg bottom section, that a support means of supporting the support portion provided at the opposite tip of the support stay is provided on the bed frame, that the support means consists of a guide portion and an engaging portion for movably supporting the support portion of the support stay, that said guide portion can support said support portion moved in relation with the pivotal rotation of the knee bottom section within the entire pivotal rotation range of the knee bottom section, and that the engaging portion is provided above or below the vacant portion adjacent to the end portion of the guide portion on which the support portion is located when the knee bottom section is pivotally lowered.

Further, this invention proposes the above-mentioned configuration, wherein a pair of support stays, each being the support stay described above, are provided on the right and left sides in the transverse direction of the leg bottom section, and are connected with each other by a connecting rod at the opposite tips of the support stays; and the ends of the connecting rod beyond the support stays form support portions. Furthermore, this invention proposes the abovementioned configuration, wherein the extreme ends of the support portions are bent like hooks. Moreover, this invention proposes the above-mentioned configuration, wherein the support portions and the hook portions are fitted with synthetic resin caps.

Still furthermore, this invention proposes the above-mentioned configuration, wherein each of the guide portions has a slope face and a low step portion at the end portion thereof on which the corresponding support portion is located when the knee bottom section is pivotally lowered.

3. Effect of the Invention

In this invention, each of the support means for supporting the support portions at the tips of the support stays consists of a guide portion and an engaging portion for movably supporting the corresponding support portion, and the guide portions can support said support portions moved in relation with the pivotal rotation of the knee bottom section within the entire pivotal rotation range of the knee bottom section. Therefore, in the state where the support portions are located on the guide portions, the support portions are moved on the guide portions in the longitudinal direction of the bed frame. Consequently, the support stays do not support the other end of the leg bottom section, and this state can be maintained within the entire pivotal rotation range of the knee bottom section.

Therefore, in the case where the knee bottom section is pivotally raised from the state where the knee bottom section and the leg bottom section lie flat, one end of the leg bottom section is raised along the pivotally rotating locus of the knee bottom section, but the other end of the leg bottom section is supported at a low position above the bed frame while it is moved toward the knee bottom section in the longitudinal direction of the bed frame.

If the knee bottom is pivotally lowered from this state, the other end of the leg bottom section is moved in the direction to leave from the knee bottom section, and the support portions are moved on the guide portions. Thus, even if the knee bottom section and the leg bottom section lie flat, the support portions are located on the guide portions.

Therefore, if the knee bottom section is pivotally raised from this state, the action as described above occurs, and in the state where the knee bottom section is pivotally raised, the other end of the leg bottom section can be supported again at a low position above the bed frame.

Next, in the case where it is desired to keep the other end of the leg bottom section at a high position when the knee bottom section is pivotally raised, the leg bottom section is raised to let the support portions go beyond the edges of the guide portions, to be disengaged from the guide portions, and to be engaged with the engaging portions provided above or below the vacant portions adjacent to the end portions of the guide portions.

In the case where the engaging portions are provided below the vacant portions adjacent to the end portions of the guide portions for example, the support portions are lowered, and the knee bottom section is pivotally raised from this state. As a result, the one end of the leg bottom section is moved in the longitudinal direction of the bed frame, being raised along the pivotally rotating locus of the knee bottom section, while the other end of the leg bottom section moves toward the knee bottom section. Therefore, the support stays are moved accordingly, and the support portions are engaged with the engaging portions. Further, in the case where the engaging portions are provided above the vacant portions adjacent to the end portions of the guide portions, the support portions are raised to be engaged with the engaging portions.

If the knee bottom section is further pivotally raised from this state, the support portions engaged with the engaging portions act as fulcrums, to pivotally raise the support stays and to thereby pivotally raise the other end of the leg bottom section. Thus, in the state where the knee bottom section is pivotally raised, the other end of the leg bottom section is supported at a high position.

If the knee bottom section is pivotally lowered, in the action reverse to the above-mentioned action, the support stays are pivotally lowered and the knee bottom section and the leg bottom section are lowered to lie flat. In this state, the support portions are located on the engaging portions. Therefore, in the case where the knee bottom section is pivotally raised next, the other end of the leg bottom section can be supported at a high position again in the state where the knee bottom section is pivotally raised.

In this invention, the extreme ends of the support portions are bent like hooks, and in this configuration, the support portions and the hook portions are fitted with synthetic resin caps, so that the support portions can be smoothly moved on the guide portions, to prevent noise occurrence.

Further, in this invention, each of the guide portions has a slope face and a low step portion at the end portion thereof where the corresponding support portion is located when the knee bottom section is pivotally lowered. In this configuration, when the leg bottom section lies flat, the position of the support portions can be lowered, so that the leg bottom section can be further lowered in height.

MEANINGS OF SYMBOLS

Figure 1:
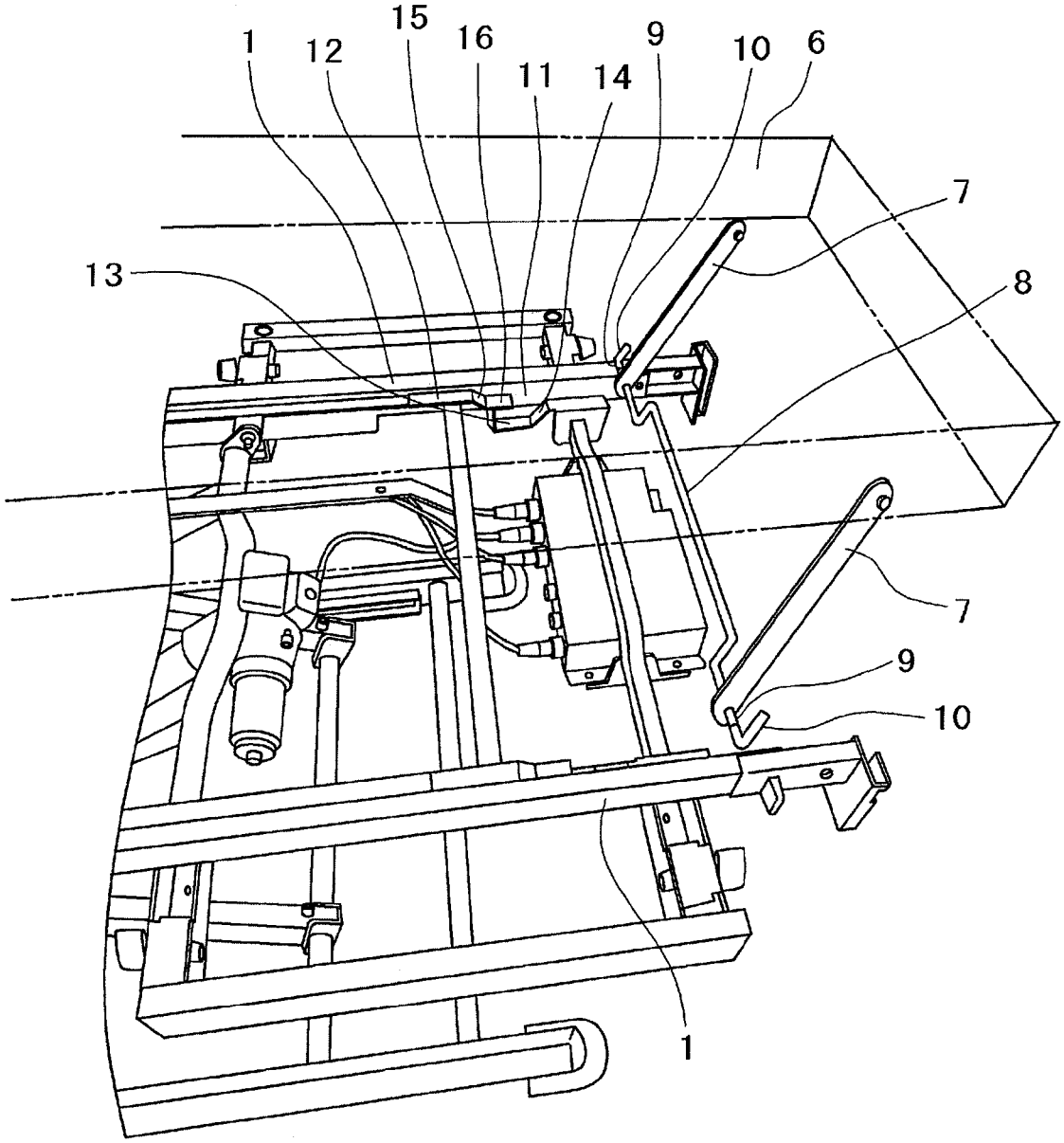
FIG. 1 is a perspective view showing an essential portion of an embodiment of this invention.
Figure 2:
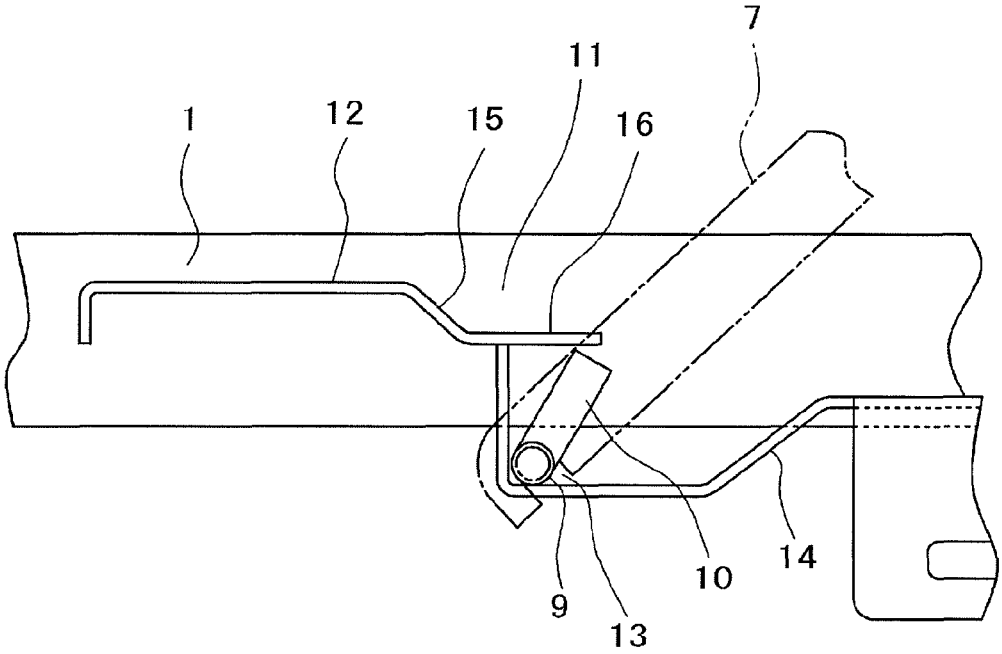
FIG. 2 is a side view showing an essential portion of the embodiment of this invention.

1 bed frame
2 knee bottom section
3 boost arm
4 action member
5 actuator
6 leg bottom section
7 support stay
8 connecting rod
9 support portion
10 hook portion
11 support means
12 guide portion
13 engaging portion
14 slope face
15 slope face
16 low step portion
a bed frame
b knee bottom section
c boost arm
d action member
e actuator
f leg bottom section
g support stay
h connecting rod
I support portion
J cranked handle portion
m,n engaging recess
0 support member

DETAILED DESCRIPTION OF THE INVENTION

An embodiment of the support mechanism for the leg bottom section of a bed of this invention is explained below in reference to FIGS. 1 to 12.

In the drawings, symbol 1 indicates a bed frame, and one end of a knee bottom section 2 is supported by the bed frame 1 in such a manner that the knee bottom section 2 can be pivotally raised and lowered. Symbol 3 indicates a pair of boost arms pivotally rotatably supported by the bed frame 1, and the boost arms 3 are connected with an actuator 5 such as a screwed shaft actuator via an action member 4, and if the actuator 5 is moved in the right/left direction in the drawings, the knee bottom section 2 can be pivotally raised and lowered. Further, one end of a leg bottom section 6 is pivotally rotatably connected with the other end of the knee bottom section 2, and a pair of support stays 7 are pivotally rotatably connected with the underside of the other end of the leg bottom section 6.

As shown in FIG. 1, the pair of support stays 7 are disposed on the right and left sides in the transverse direction of the leg bottom section 6, and the opposite tips of the support stays 7 are connected with each other by a connecting rod 8. The near end portions of the connecting rod 8 beyond the opposite tips of the support stays 7 form support portions 9, and the extreme ends of the connecting rod 8 form hook portions 10. Though not shown in the drawings, the support portions 9 and the hook portions 10 are fitted with synthetic resin caps, to allow smoother sliding and to prevent the occurrence of noise.

On the other hand, the bed frame 1 is provided with a pair of support means 11 for supporting the support portions 9, and each of the support means 11 consists of a guide portion 12 and an engaging portion 13 for movably supporting the corresponding support portion 9. As can be seen from the action described later, the guide portions 12 can support the support portions 9 moved in relation with the pivotal rotation of the knee bottom section 2 within the entire pivotal rotation range of the knee bottom section 2. The engaging portions 13 are formed below the vacant portions adjacent to the end portions of the guide portions 12 on which the support portions 9 are located when the knee bottom section 2 is pivotally lowered. Further, each of the engaging portions 13 has a slope face 14 inclined upward in the direction away from the above-mentioned end of the guide portion 12. On the other hand, each of the guide portions 12 has a slope face 15 and a low step portion 16 at the end portion thereof on which the corresponding support portion 9 is located when the knee bottom section 2 is pivotally lowered. Meanwhile, the engaging portions 13 can also be provided above the vacant portions adjacent to the end portions of the guide portions 12 on which the support portions 9 are located when the knee bottom section 2 is pivotally lowered as described above.

Figure 3:
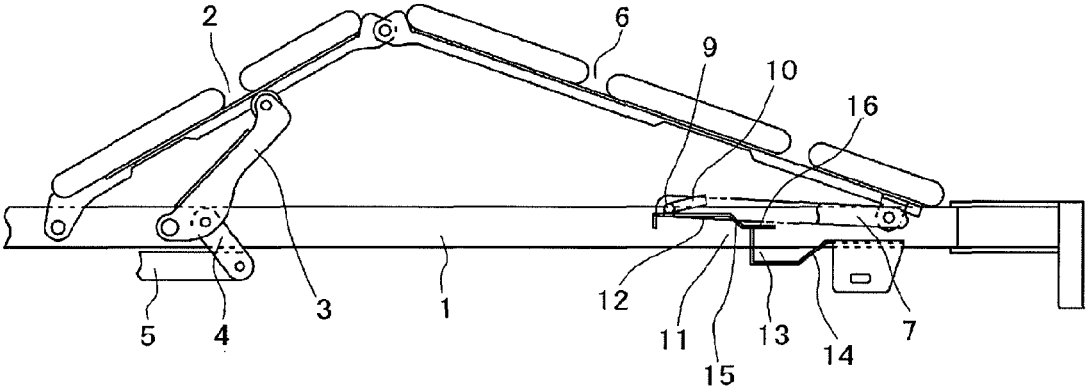
FIG. 3 is a side view showing the embodiment of this invention.

The action of this invention in the above-mentioned configuration is explained below. First of all, FIG. 3 shows the state where the knee bottom section 2 is pivotally raised while the support portions 9 are located on the guide portions 12. In this state, the support portions 9 are located on the guide portions 12 on the left side in the drawing, and the support stays 7 do not support the other end of the leg bottom section 6. Therefore, the one end of the leg bottom section 6 is raised together with the knee bottom section 2. However, the other end of the leg bottom section 6 is positioned on the bed frame 1, namely, supported at a low position.

Figure 4:
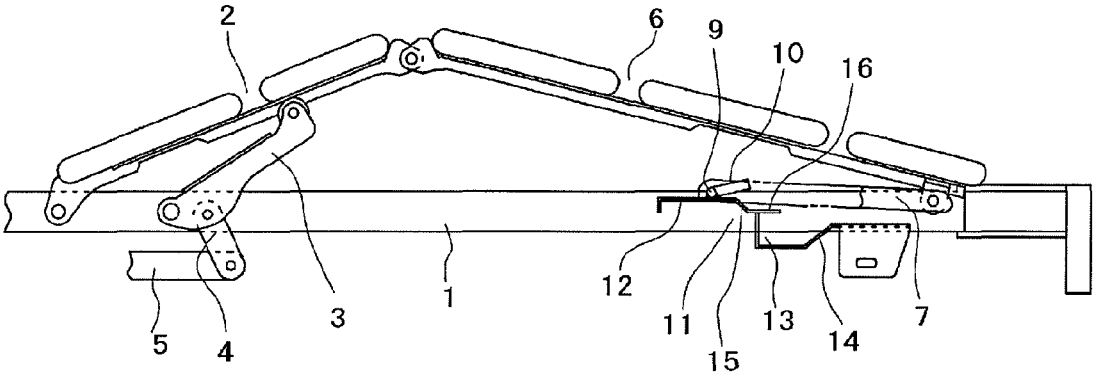
FIG. 4 is a side view showing an aspect different from that of FIG. 3.

If the knee bottom section 2 is pivotally lowered from this state, the other end of the leg bottom 6 is moved rightward as shown in FIG. 4, being supported on the bed frame 1, and together with it, the support portions 9 are also moved rightward on the guide portions 12.

Figure 5:
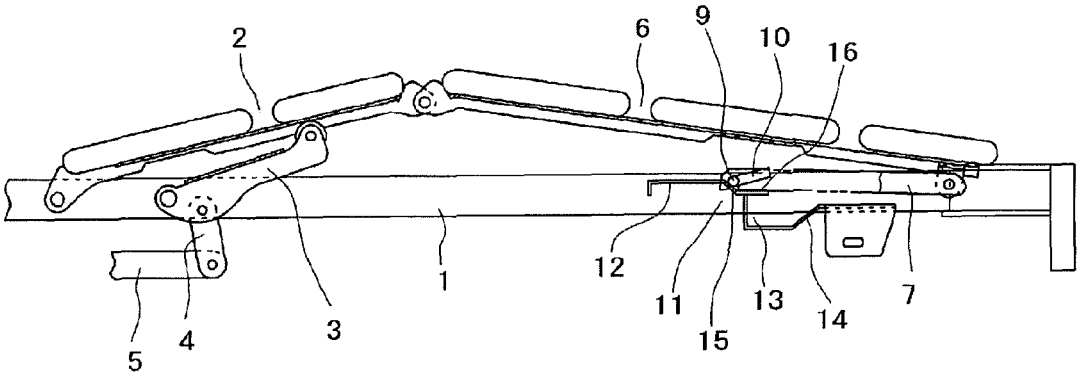
FIG. 5 is a side view showing an aspect further different from those of the above drawings.
Figure 6:
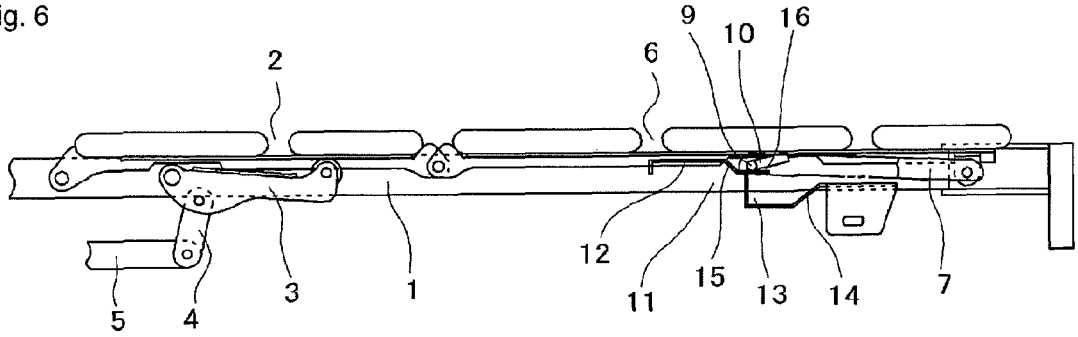
FIG. 6 is a side view showing an aspect further different from those of the above drawings.

If the knee bottom section 2 is pivotally lowered further from the state of FIG. 4, the support portions 9 reach the slope faces 15 as shown in FIG. 5, and then in the state where the knee bottom section 2 and the leg bottom section 6 lie flat, the support portions 9 are moved further from the slope faces 15, to be located on the low step portions 16 as shown in FIG. 6.

As described above, the guide portions 12 can support the support portions 9 moved in relation with the pivotal rotation of the knee bottom section 2 within the entire pivotal rotation range of the knee bottom section 2, and even when the knee bottom section 2 reaches the lowest end in the entire pivotal rotation range, the support portions 9 are located on the guide portions 12. Therefore, in the case where the knee bottom section 2 is pivotally raised from this state, namely, from the state where the knee bottom section 2 and the leg bottom section 6 lie flat, the one end of the leg bottom section 6 is raised together with the knee bottom section 2, taking the course reverse to the course taken when the knee bottom section 2 is pivotally lowered, and is supported at a high position. On the other hand, the other end of the leg bottom section 6 is supported at a low position on the bed frame 1.

Figure 7:
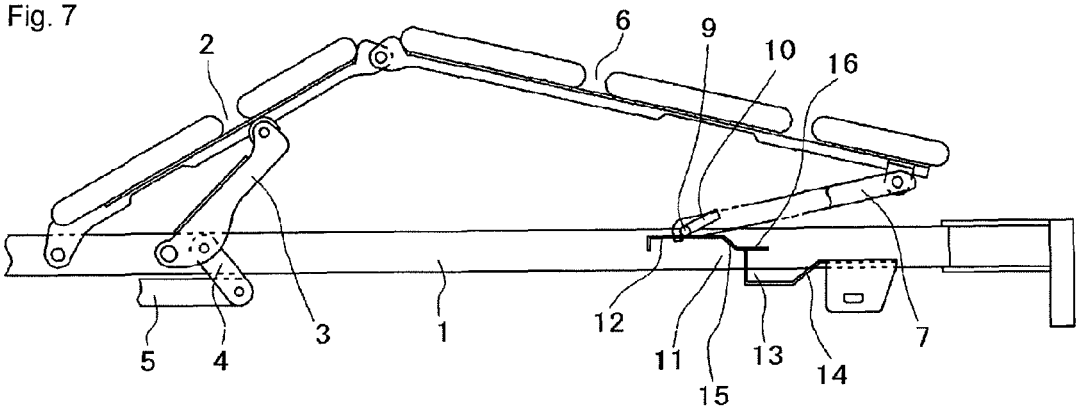
FIG. 7 is a side view showing an aspect further different from those of the above drawings.
Figure 8:
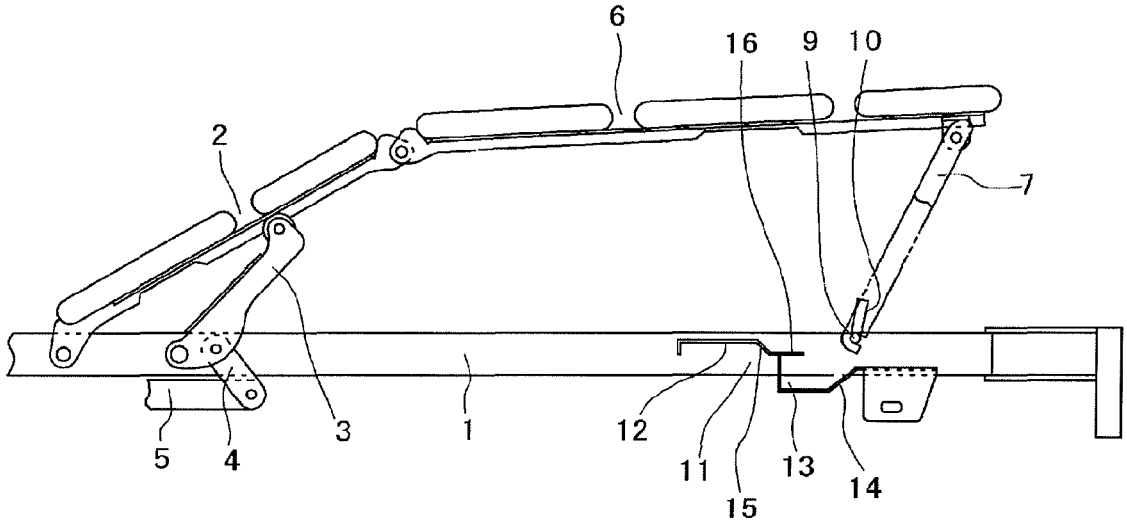
FIG. 8 is a side view showing an aspect further different from those of the above drawings.

Next, for example, in the state of FIG. 3, if the other end of the leg bottom section 6 is pivotally raised as shown in FIG. 7, the support portions 9 are moved rightward on the guide portions 12 and finally reach the vacant positions adjacent to the end portions of the guide portions 12 as shown in FIG. 8.

Figure 9:
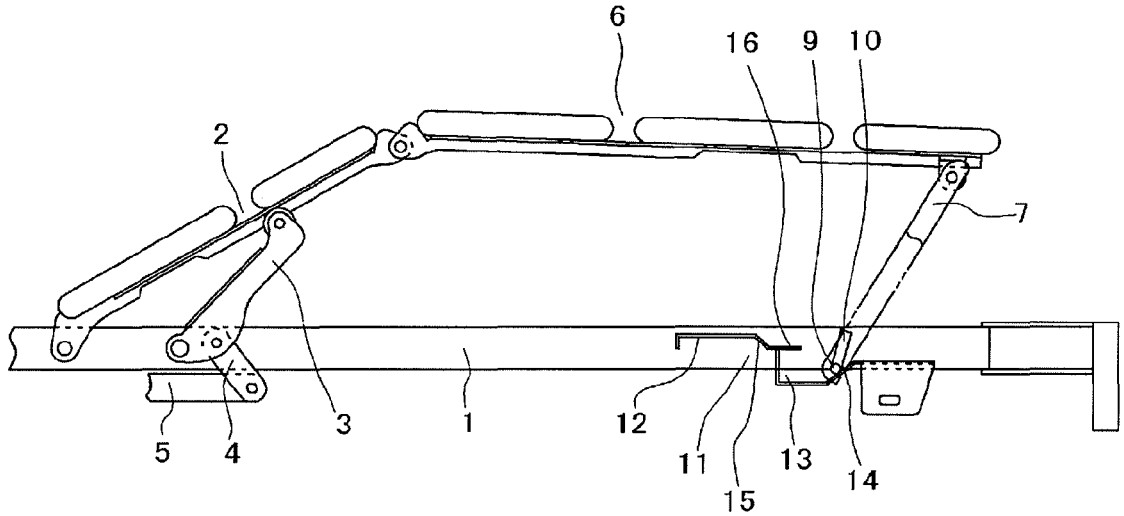
FIG. 9 is a side view showing an aspect further different from those of the above drawings.
Figure 10:
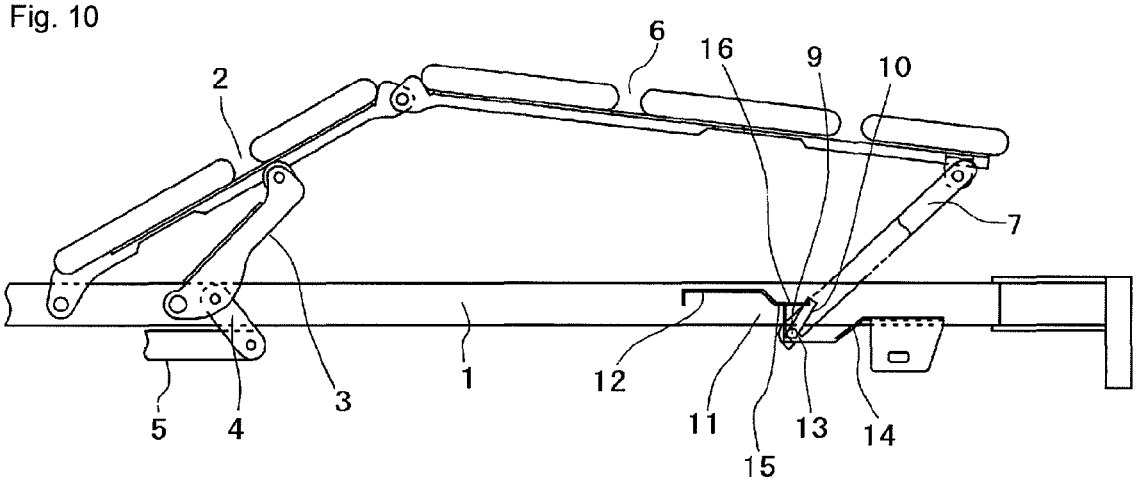
FIG. 10 is a side view showing an aspect further different from those of the above drawings.
Figure 11:
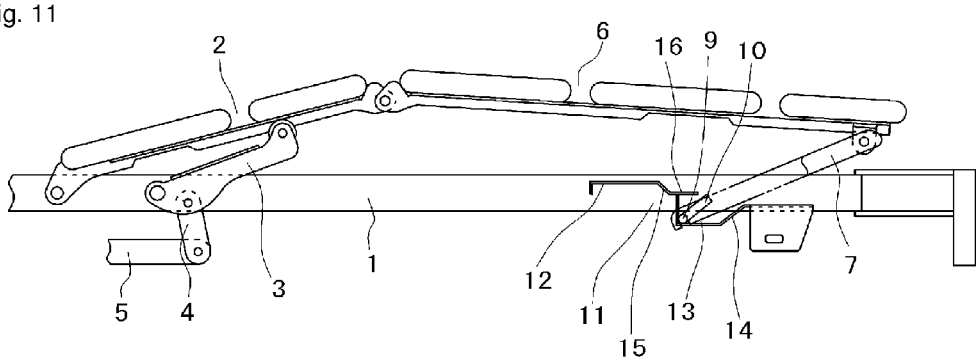
FIG. 11 is a side view showing an aspect further different from those of the above drawings.

In the case of this embodiment, the support stays 7 are prevented from being pivotally rotated counterclockwise in the drawings beyond the state of FIG. 8. Therefore, if the leg bottom section 6 is pivotally lowered in this state, the support portions 9 reach the slope faces 14 formed on the right side of the engaging portions 13 as shown in FIG. 9, and if the leg bottom section 6 is further pivotally lowered, the support portions 9 contact the walls of the engaging portions 13 as shown in FIG. 10, to be kept engaged with the engaging portions 13.

While the support portions 9 are engaged with the engaging portions 13, the support stays 7 support the other end of the leg bottom section 6. Therefore, in the state where the knee bottom section 2 is pivotally raised, the other end of the leg bottom section 6 is supported at a high position by the support stays 7.

Figure 12:
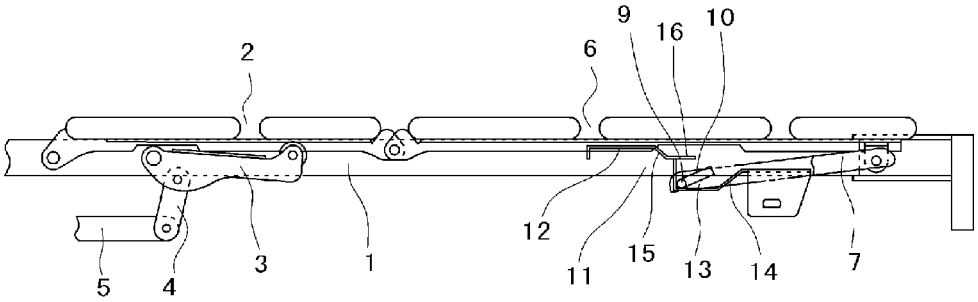
FIG. 12 is a side view showing an aspect further different from those of the above drawings.
Figure 13:
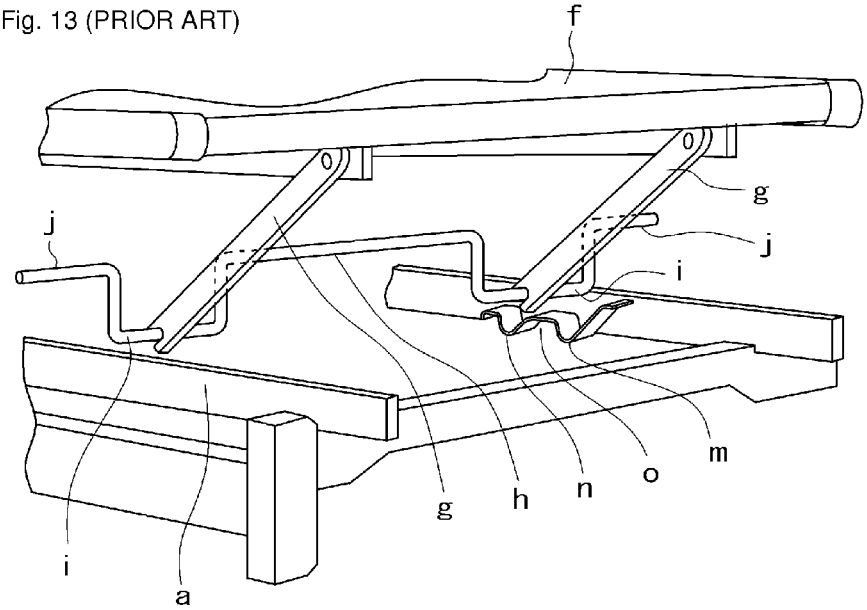
Fig. 13 (PRIOR ART)
FIG. 13 is a perspective view showing an essential portion of a conventional support mechanism for a leg bottom section.
Figure 14:
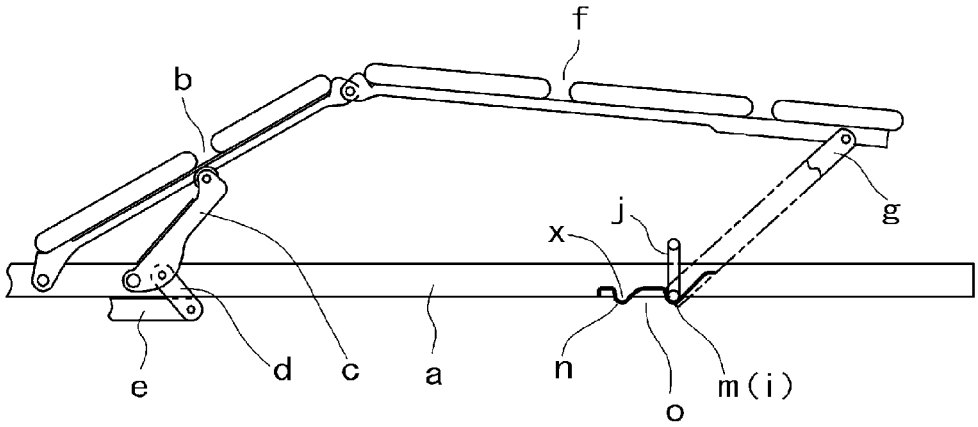
Fig. 14 (PRIOR ART)
FIG. 14 is a side view showing the action of the conventional support mechanism.
Figure 15:
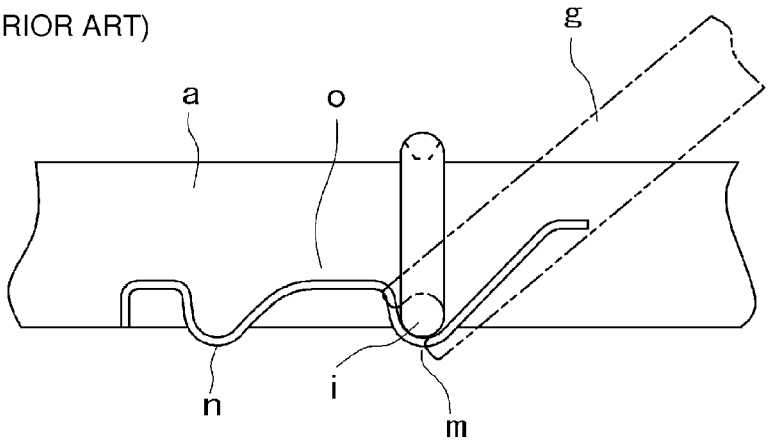
Fig. 15 (PRIOR ART)
FIG. 15 is an enlarged view showing an essential portion of FIG. 14.
Figure 16:
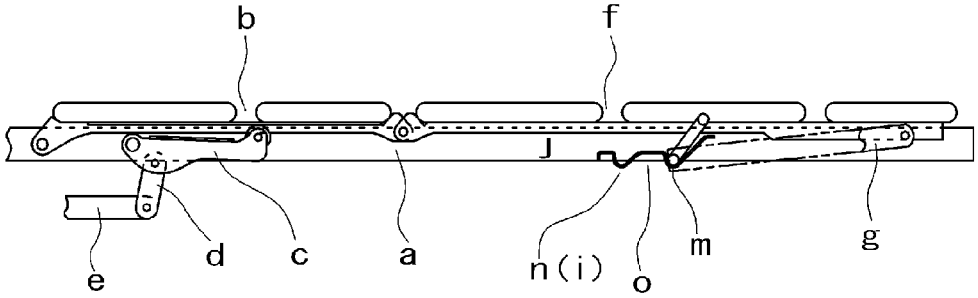
Fig. 16 (PRIOR ART)
FIG. 16 is a side view showing another aspect of the action of the conventional support mechanism.
Figure 17:
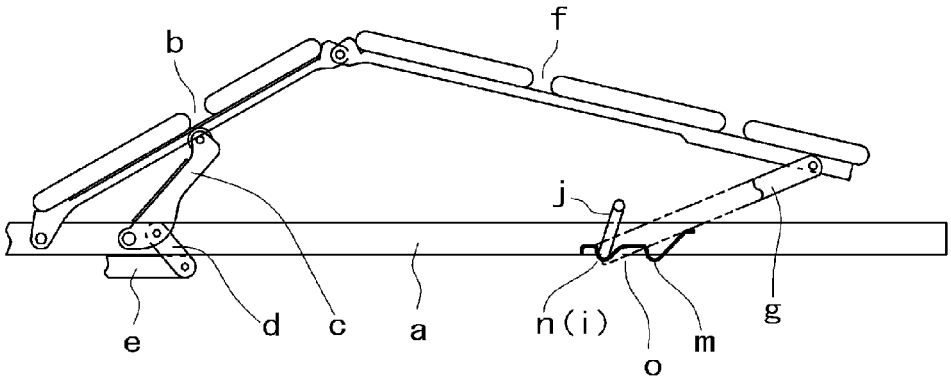
Fig. 17 (PRIOR ART)
FIG. 17 is a side view showing a further other aspect of the action of the conventional support mechanism.
Figure 18:
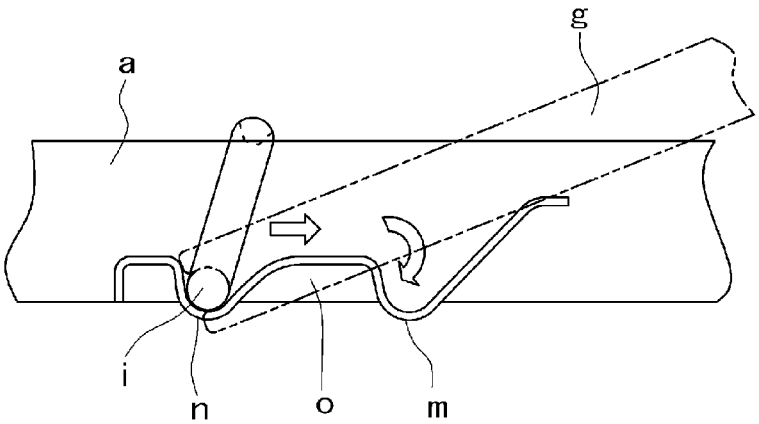
Fig. 18 (PRIOR ART)
FIG. 18 is an enlarged view showing an essential portion of FIG. 17.

If the knee bottom section 2 is pivotally lowered from this state, the other end of the leg bottom section 6 is moved in the direction away from the knee bottom section 2, while being supported by the support stays 7. The knee bottom section 2 and the leg bottom section 6 undergo the state of FIG. 11 and lie flat as shown in FIG. 12.

In this state, the support portions 9 are positioned below the guide portions 12. Therefore, in the case where the knee bottom section 2 is pivotally raised next, the one end of the leg bottom section 6 is raised together with the knee bottom section 2, and the other end of the leg bottom section 6 is raised, while being supported by the support stays 7. Thus, as shown in FIG. 10, the other end of the leg bottom section 6 can be supported at a high position again in the state where the knee bottom section 2 is pivotally raised.

Meanwhile, as described above, in the case of this embodiment, the support stays 7 are prevented from being pivotally rotated counterclockwise in the drawings beyond the state of FIG. 8, and in the configuration where the pivotal rotation is not prevented, this invention can also be applied. That is, in this case, after the leg bottom section 6 is raised, the support stays 7 can be held by hand and pivotally rotated forward, to shift from the state of FIG. 8 to the state of FIG. 9, for bringing the support portions 9 into the predetermined positions.

Next in the case where it is desired to shift from the support mode in which the other end of the leg bottom section 6 is supported at a high position in the state where the knee bottom section 2 is pivotally raised, to the support mode in which the other end of the leg bottom section 6 is supported at a low position in the state where the knee bottom section 2 is pivotally raised, it is only required to raise the other end of the leg bottom section 6 and to hold the support stays 7 by hand, for pivotally rotating the support stays 7 forward in order to move the support portions 9 adjacent to the ends of the engaging portions 13 onto the guide portions 12.

Therefore, in the case where the pivotal raising of the leg bottom section 6 relatively to the knee bottom section 2 is possible in the state where the knee bottom section 2 and the leg bottom section 6 lie flat, the switching operation between the support mode in which the other end of the leg bottom section 6 is supported at a high position in the state where the knee bottom section 2 is pivotally raised and the support mode in which the other end of the leg bottom section 6 is supported at a low position in the state where the knee bottom section 2 is pivotally raised can be performed irrespective of the positions assumed by the knee bottom section 2 and the leg bottom section 6.

Also in the case where the pivotal raising of the leg bottom section 6 relatively to the knee bottom section 2 is impossible in the state where the knee bottom section 2 and the leg bottom section 6 lie flat, the switching operation between the support modes can be performed as appropriate by raising both the leg bottom section 6 and the knee bottom section 2.

As described above, the support mechanism for the leg bottom section of a bed of this invention has such advantages that the leg bottom section support mode at the time of pivotally raising the knee bottom section can be easily changed and set as desired in response to the physical condition of the user and that the set support mode can be maintained. Therefore, this invention, which is applicable to medical and household beds, is highly industrially applicable.

The invention claimed is:

1. A support mechanism for a leg bottom section of a bed, the support mechanism comprising:

a bed frame;

a knee bottom section supported at one end on the bed frame in such a manner that the knee bottom section can be pivotally raised and lowered;

a leg bottom section pivotally rotatably connected with the other end of the knee bottom section;

a support stay having a first end and a second end, wherein the first end is pivotally rotatably connected with an underside of an end of the leg bottom section;

a support structure for supporting the second end of the support stay, the support structure being provided on the bed frame, the support structure including a guide portion and an engaging portion for movably supporting the second end of the support stay via a support portion, said guide portion being configured to support said support portion as it moves in relation with the pivotal rotation of the knee bottom section within the entire pivotal rotation range of the knee bottom section, and the engaging portion being provided below an end portion of the guide portion on which the support portion is located when the knee bottom section is pivotally lowered, wherein the engaging portion includes a slope face that is inclined in a direction away from the guide portion.

2. A support mechanism for a leg bottom section of a bed, the support mechanism comprising:

a bed frame;

a knee bottom section supported at one end of the knee bottom section on the bed frame in such a manner that the knee bottom section can be pivotally raised and lowered;

a leg bottom section pivotally rotatably connected with the other end of the knee bottom section;

a pair of support stays pivotally rotatably connected with an underside of an end of the leg bottom section, said support stays being provided on right and left sides in the transverse direction of the leg bottom section, wherein said support stays are connected with each other at opposite ends thereof by a connecting rod, and ends of the connecting rod extend outwardly beyond the support stays so as to form support portions;

a pair of support structures for supporting the support portions, respectively, the support structures being provided on the bed frame, each of the support structures including a guide portion and an engaging portion for movably supporting the respective support portion, said guide portion being configured to support said support portion as it moves in relation with the pivotal rotation of the knee bottom section within the entire pivotal rotation range of the knee bottom section, and the engaging portion being provided below an end portion of the guide portion on which the support portion is located when the knee bottom section is pivotally lowered, wherein outermost ends of the support portions are bent in the form of hooks.

3. The support mechanism according to claim 2, wherein the support portions and the hook portions are fitted with synthetic resin caps.

4. The support mechanism according to claim 1, wherein the guide portion has a slope face and a low step portion extending from an end of the slope face, and the support portion is located on the low step portion when the knee bottom section is pivotally lowered to a state where the knee bottom section and the leg bottom section lie flat.

5. A support mechanism for the leg bottom section of a bed, according to claim 2, wherein each of the guide portions has a slope face and a low step portion extending from an end of the slope face, and the corresponding support portion is located on the low step portion when the knee bottom section is pivotally lowered to a state where the knee bottom section and the leg bottom section lie flat.

6. The support mechanism according to claim 3, wherein each of the guide portions has a slope face and a low step portion extending from an end of the slope face, and the corresponding support portion is located on the low step portion when the knee bottom section is pivotally lowered to a state where the knee bottom section and the leg bottom section lie flat.

7. A support mechanism for a leg bottom section of a bed, the support mechanism comprising:

a bed frame;

a knee bottom section supported at one end of the knee bottom section on the bed frame in such a manner that the knee bottom section can be pivotally raised and lowered;

a leg bottom section pivotally rotatably connected with the other end of the knee bottom section;

a pair of support stays pivotally rotatably connected with an underside of an end of the leg bottom section, said support stays being provided on right and left sides in the transverse direction of the leg bottom section, wherein said support stays are connected with each other at opposite ends thereof by a connecting rod, and ends of the connecting rod extend outwardly beyond the support stays so as to form support portions;

a pair of support structures for supporting the support portions, respectively, the support structures being provided on the bed frame, each of the support structures including a guide portion and an engaging portion for movably supporting the respective support portion, said guide portion being configured to support said support portion as it moves in relation with the pivotal rotation of the knee bottom section within the entire pivotal rotation range of the knee bottom section, and the engaging portion being provided below an end portion of the guide portion on which the support portion is located when the knee bottom section is pivotally lowered, wherein each of the engaging portions includes a slope face that is inclined in a direction away from the corresponding guide portion.

* * * * *